United States Patent [19]

Winans et al.

[11] 4,209,411

[45] Jun. 24, 1980

[54] METHYLOL POLYESTERS OF $C_{12}$–$C_{22}$ HYDROCARBON SUBSTITUTED SUCCINIC ANHYDRIDE OR ACID, THEIR PREPARATION AND USE AS ADDITIVES FOR LUBRICANTS AND FUELS

[75] Inventors: Esther D. Winans, Colonia; Jack Ryer, East Brunswick; Antonio Gutierrez, Mercerville; Harold Shaub, New Providence, all of N.J.

[73] Assignee: Exxon Research & Engineering Co., Florham Park, N.J.

[21] Appl. No.: 22,952

[22] Filed: Mar. 23, 1979

[51] Int. Cl.[2] ..... C10M 1/24

[52] U.S. Cl. ..... 252/56 D; 44/70; 44/63; 252/396; 260/345.8 R; 560/193

[58] Field of Search ..... 44/70, 63; 252/56 R, 252/56 D, 396; 260/345.8 R; 560/193

[56] References Cited

U.S. PATENT DOCUMENTS

| | | | |
|---|---|---|---|
| 3,090,753 | 5/1963 | Matuszak et al. | 252/396 |
| 3,639,242 | 2/1972 | Le Suer | 44/70 |
| 3,708,522 | 1/1973 | Le Suer | 44/70 |
| 3,859,318 | 1/1975 | Le Suer | 252/56 D |
| 4,012,438 | 3/1977 | Lavigne | 252/56 D |

*Primary Examiner*—Winston A. Douglas
*Assistant Examiner*—Y. Harris-Smith
*Attorney, Agent, or Firm*—Roland A. Dexter

[57] ABSTRACT

Methylol polyester derivatives of $C_{12}$–$C_{22}$ hydrocarbon substituted succinic anhydride or acid which are the equimolar reaction products of said $C_{12}$–$C_{22}$ hydrocarbon substituted succinic anhydride or acid and a cyclic poly(methylol) compound provide activity: in fuels as rust inhibitors; in automatic transmission fluids as copper corrosion inhibitors; and, in automotive, industrial and lubricating oils as sludge dispersants, rust-inhibitors, friction reducers (lubricity agents) and copper alloy corrosion inhibitors.

11 Claims, No Drawings

METHYLOL POLYESTERS OF $C_{12}$–$C_{22}$ HYDROCARBON SUBSTITUTED SUCCINIC ANHYDRIDE OR ACID, THEIR PREPARATION AND USE AS ADDITIVES FOR LUBRICANTS AND FUELS

BACKGROUND OF THE INVENTION

1. Field of the Invention

The invention relates to novel oil-soluble methylol polyesters derived from the reaction of a hydrocarbon substituted succinic anhydride or acid and a cyclic poly(methylol) compound. These novel oil-soluble polyesters have utility as additives for oleaginous compositions and systems including fuels, automatic transmission fluids and lubricating oils.

2. Description of the Prior Art

In the operation of a internal combustion engine, there are many "Boundary Lubrication" conditions where two rubbing surfaces must be lubricated, or otherwise protected so as to prevent wear and to insure continued movement. Moreover, where, as in most cases, friction between the two surfaces will increase the power required to effect movement and where the movement is an integral part of an energy conversion system, it is most desirable to effect the lubrication in a manner which will minimize this friction and/or reduce wear. As is also well known, both wear and friction can be reduced, with various degrees of success, through the addition of a suitable additive or combination thereof, to a natural or synthetic lubricant. Similarly, continued movement can be insured, again with varying degrees of success, through the addition of one or more appropriate additives.

While there ae many known lubricant additives which may be classified as antiwear, antifriction and extreme pressure agents and some may in fact satisfy more than one of these functions as well as provide other useful functions, it is also known that many of these additives act in a different physical or chemical manner and often compete with one another, e.g. they may compete for the surface of the moving metal parts which are subjected to lubrication. Accordingly, extreme care must be exercised in the selection of these additives to insure compatibility and effectiveness.

Known ways to solve the problem of energy losses due to high friction in crankcase lubrication include the use of synthetic ester base oils which are expensive, the use of insoluble molybdenum sulfide and graphite dispersions which have the disadvantage of giving the oil composition a black or hazy appearance and the use of lubricants containing dialkyl dithiophosphates (an additive known to provide enhanced antioxidant and antiwear properties to the lubricant) in combination with an ashless dispersant and an ester of a polycarboxylic acid and glycol (see U.S. Pat. No. 4,105,571). The referenced ashless dispersant includes ester containing types derived from alkenylsuccinic anhydride wherein the alkenyl group contains about 50 to about 400 carbon atoms (see col. 6, lines 35–38 of said U.S. Pat. No. 4,105,571) and monohydric and polyhydric alcohols such as cyclohexanol, cyclopentanol, . . ., 2-methylcyclohexanol, . . ., pentaerythritol, trimethylol propane, . . ., etc., (see col. 7, lines 30–64 of said U.S. Pat. No. 4,105,571).

At least two cyclic poly(methylol) compounds are taught in the literature:

2,2,6,6-tetramethylol cyclohexanol is shown in U.S. Pat. No. 2,493,733; and, anhydroenneaheptitol (a/k/a tetrahydro-3,3,5,5-tetrakis (hydroxy methyl)-4-pyranol) is shown in the Encyclopedia of Chemical Technology, Second Edition, by Kirk-Othmer in Vol. 1, page 596 published by Interscience Publishers, New York, New York.

SUMMARY OF THE INVENTION

It has now been discovered that novel hydrocarbon soluble methylol polyester derivatives can be formed from the equimolar reaction of a $C_{12}$–$C_{22}$, preferably $C_{18}$, hydrocarbyl substituted succinic anhydride or acid and a cyclic poly(methylol) compound of the class consisting of 2,2,6,6-tetramethylol cyclohexanol (hereinafter designated alternatively as TMC), tetrahydro-3,3,5,5-tetrakis-(hydroxy-methyl)-4-pyranol (hereinafter designated alternatively as AEH) and tetrahydro-3,3,5-tris-(hydroxymethyl)-5-methyl-4-pyranol (hereinafter designated alternatively as tris-AEH).

For lubricating oil compositions, the methylol polyester derivatives of the invention have been found surprisingly to be highly useful as friction-reducing additives as well as providing enhanced antirust and copper corrosion inhibition activities. These various activities obtain even though the hydrocarbon chain of the succinic acid or anhydride substituent has from 12 to 22 carbons in contrast to the usual teaching that to be useful in lubricating oil systems a carbon chain length of at least 50 carbons is required for the succinic anhydride substituent.

The aliphatic hydrocarbon substituent of the polyesters of this invention can be branched and can possess unsaturation. For applications of the additive compounds in fuels such as gasoline, the carbon chain length is from 12 to 20, preferably 18, carbon atoms, one operational embodiment of the invention thus is a composition comprising a major proportion of a liquid hydrocarbon of the class consisting of fuels and lubricating oils and a minor but at least friction reducing amount of a hydrocarbon soluble methylol polyester of the invention, said polyester preferably being from 0.001 to 20 wt. % of said lubricating oil composition and from 2 to 10 parts per million for said fuel composition.

Illustrative of this invention is the following representative equimolar reaction (portrayed as the reaction of TMC and 2-octadecenyl succinic anhydride [hereinafter designated alternativey as OSA]).

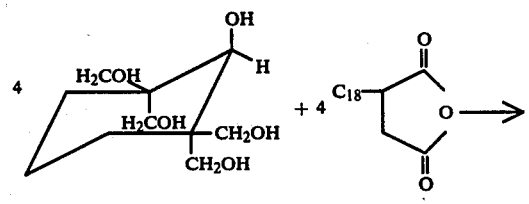

TMC OSA

-continued

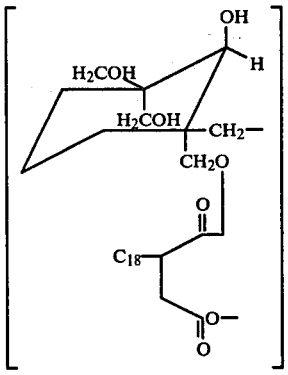

The methylol polyester of 2-octadecenyl succinic anhydride and 2,2,6,6-tetramethylol cyclohexane) is also known as tetrakis(2,2'-bis methylene (1-hydroxy-6,6 dimethylol cyclohexyl) octadecenyl succinate).

DESCRIPTION OF THE PREFERRED EMBODIMENTS OF THE INVENTION

Succinic Acids and Anhydrides

Any $C_{12}$ to $C_{22}$, preferably $C_{18}$ 2-alkyl, 2-alkenyl-2,3-dialkyl or 2,3-cyclo-alkenyl substituted succinic acid anhydride or its corresponding acid, or mixtures thereof can be used in the present invention. The alkyl or alkenyl group can be branched or straight chain. Preferred is octadecenylsuccinic anhydride having a structure as follows:

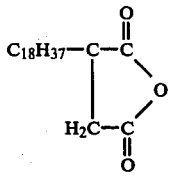

The hydrocarbon substituted succinic anhydrides are readily available from the reaction of maleic anhydride with olefins, polyolefins or with their chlorinated derivatives. Interaction of the alkenyl substituent with maleic anhydride [Ene reactions] gives alkenylsuccinic anhydrides. The olefin can, if desired, be first halogenated, for example, chlorinated or brominated to about 2 to 5 wt. % chlorine, or about 4 to 8 wt. % bromine, based on the weight of olefin, and then reacted with the maleic anhydride.

Other halogenation techniques for attaching the maleic anhydride to a short hydrocarbon chain, involve first halogenating the maleic anhydride and then reacting with the olefin, or by blowing halogen gas, e.g. chlorine, through a mixture of the olefin and maleic anhydride, then heating to 150° to 220° C. in order to remove HCl gas, and thereby couple the halogenated olefin with said halogenated maleic anhydride in a Diels-Alder condensation. This condensation inherently produces a 1,2-cycloalkenyl substituent, i.e. butenylene or hydrocarbyl substituted butenylene dependent upon the carbon chain length and structure, e.g. branched, unbranched and/or hetero substituted of said halogenated olefin.

The succinic acid counterpart is readily produced by hydrolysis of said anhydride.

Cyclic Poly(methylol) Compounds

The cyclic poly(methylol) compounds are of the class consisting of 2,2,6,6-tetramethylol cyclohexanol, tetrahydro-3,3,5,5-tetrakis-(hydroxymethyl)-4-pyranol and tetrahydro-3,3,5-tris-(hydroxymethyl)-5-methyl-4-pyranol and have the generic structural formula as follows:

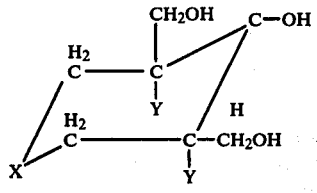

wherein y is $—CH_3$ or $—CH_2OH$ and X is $—CH_2—$ or —O—.

Reaction Conditions

The formation of the novel methylol polyesters of the present invention can be effected by reacting a mole of the hydrocarbon substituted succinic acid anhydride with a mole of the cyclic poly(methylol) compound as previously portrayed in Equation 1. The mode of addition of reactants does not appear to affect product composition and convenience will usually dictate which reagent is added to the other. For reasons not fully understood, the reaction is substantially equimolar and is conjectured to result in a cyclic reaction product as earlier presented.

The esterification reaction is readily carried out wherein the reactants are heated together neat or in an inert solvent such as mineral oil while sparging with an inert gas such as nitrogen to remove the water of condensation or in a solvent such as xylene which can also provide for removal of the water by entrainment in the xylene. The esterification process can be carried out at 100°-240° C., preferably at 120°-220° C., and in the presence (if desired) of a conventional esterification catalyst e.g. p-toluene-sulfonic acid until the reaction is complete as measured by collection of a stoichiometric amount of water of condensation or infrared analysis of the product is indicated by maximum absorptions for ester functionality.

Methylol Polyester Products

Measurement of the number average molecular weights ($\overline{M}n$) of the cyclic poly(methylol) esters of octadecenyl succinic anhydride have been characterized by values ranging from 2200 to 2800. From these results it can be postulated that the methylol polyester products of the invention are each essentially a tetra ester of the following structure

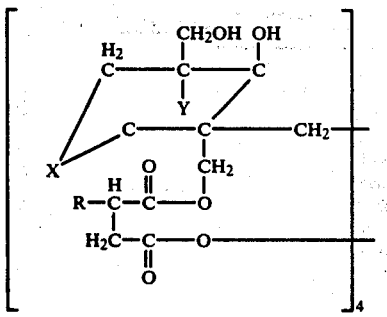

wherein X represents —$CH_2$ or —O—, y represents —$CH_3$ or —$CH_2OH$ and R represents a hydrocarbon substituent of 12 to 22 carbons.

The following preparations and examples are included herein as further description and illustrative of the present invention.

EXAMPLE 1

Preparation of TMC [2,2,6,6-tetramethylolcyclohexanol]

98 grams (one mole) of cyclohexanone was combined with 166 g (5 moles) of paraformaldehyde and 900 ml of water in a 2-liter 4 -neck flask. This mix was cooled by an ice bath to 5° C. and 35 grams (0.61 moles) of calcium oxide was added over a 20 -minute period. The temperature was allowed to rise slowly. After 1 hour approximately 3 ml of formic acid was added to neutralize the mix. Stirring was continued overnight. The mixture was evaporated on a rotafilm evaporator to remove all the water; the residue was dissolved in 750 cc hot absolute methanol and filtered through a steam suction filter to remove calcium formate. The filtrate yielded 134 grams of white solids on cooling, a 61% yield of product, TMC. A small sample recrystallized from methanol, on analyses gave 54.45% carbon (theor 54.52) and 9.06% hydrogen (theor 9.15). The crude product had a hydroxyl number of 1138 mgs KOH per gram sample (theoret 1273).

EXAMPLE 2

Preparation of AEH [tetrahydro-3,3,5,5-tetrakis (hydroxymethyl)-4 pyranol] "Anhydroenneaheptitol"

Seventy-four grams (one mole) of calcium hydroxide was added with stirring to a mixture of 116 g (2 moles) of acetone and 485 g (16.2 moles) paraformaldehyde in 1 liter of water. External heat was applied to 40° C. to initiate the reaction which is exothermic. The reaction was not allowed to exceed 55° C. and was kept at this temperature for 2 hours. The almost clear solution was neutralized with approximately 80 g of conc. $H_2SO_4$, followed by the addition of 1 mole of oxalic acid.

The white solid was filtered and the filtrate stripped under vacuum. The residue was dissolved in methanol and filtered. This filtrate was vacuum evaporated to yield 375 g of crude product. The yield was 85%. The hydroxyl number of the product was 1029 mgs KOH per g of sample (theoretical value is 1261).

EXAMPLE 3

Preparation of TRIS AEH [Tetrahydro-3,5,5-tris-(hydroxymethyl) 5-methyl-4-pyranol]

Two moles (144 g) of methylethylketone and 13 moles (390 g) of paraformaldehyde were combined with 2 liters of $H_2O$ in a 5-liter flask. One mole (74 g) of calcium hydroxide was added; the mix was warmed to 40° C. and it maintained this temperature for several hours. After stirring overnight the mix was made slightly acid with 50% acetic acid. The water was removed on a rotafilm evaporator and the residue extracted with hot absolute methanol to remove the product. Evaporating the methanol extract produced 235 grams of viscous crude product. The hydroxyl number was 1121 mgs KOH per g (theoretical value is 1087).

EXAMPLE 4

0.2 mole (70 g) of octadecenyl succinic anhydride and 0.2 mole (44 g) of TMC were slurried with xylene and then heated to 140° C. for one-half hour to give a clear solution. The xylene was stripped off in a half-hour at 180° C. The product had a hydroxyl number of 163 and a Saponification Number of 200. The molecular weight by vapor pressure osmometry was 1977.

EXAMPLE 5

1.34 moles (470 g) of octadecenyl succinic anhydride and 1.34 moles (295 g) of TMC were combined with 741 grams of a diluent oil and heated at 180° C. for 3 hours. A nitrogen sparge was used to strip off the water.

EXAMPLE 6

Preparation of the methylol polyester of 2-octadecenyl succinic anhydride and AEH 0.5 moles (175 g) of octadecenyl succinic anhydride was heated to 100° C. and 0.5 moles (111 g) of AEH added. The mix was heated to 180° C. for 2 hours and 15 ml of water was collected from the reaction. The product was dissolved in hexane, filtered, evaporated and diluted to 50% by weight with solvent oil.

EXAMPLE 7

Preparation of the Methylol Polyester of 2-Octadecenylsuccinic anhydride and tris AEH Seventy grams (0.2 mole) of octadecenylsuccinic anhydride and 41.2 g (0.2 mole) of tris AEH were heated together at 150° C. for 2 hours with a nitrogen sparge. The solid product had a hydroxyl number of 212 mgs KOH per gram of sample.

USE OF THE POLYESTER ADDITIVE IN HYDROCARBON COMPOSITIONS

The oil-soluble polyester reaction products of this invention can be incorporated into a wide variety of hydrocarbon compositions. They can be used in lubricating oil compositions, such as automotive crankcase lubricating oils, automatic transmission fluids, etc., in concentrations generally within the range of about 0.01 to 20 wt. %, e.g. 0.1 to 10 wt. %, preferably 0.3 to 3.0 wt. %, of the total composition. The lubricants to which the polyester products can be added include not only hydrocarbon oils from petroleum, but also include synthetic lubricating oils such as polyethylene oils; alkyl esters of dicarboxylic acid; complex esters of dicarboxylic acid, polyglycol and alcohol; alkyl esters of carbonic or phosphoric acids; polysilicones; fluorohydrocarbon oils; mixtures of mineral lubricating oil and synthetic oils in any proportion, etc.

When the polyol products of this invention are used in petroleum fuels such as gasoline, kerosene, diesel fuels, No. 2 fuel oil and other middle distillates to provide antirust properties, a concentration of the additive in the fuel of from 4 to 20 parts per million based on the weight of the total composition, will usually be employed.

The polyester additives may be conveniently dispensed as an additive concentrate of from 2 wt. % to 100 wt. % with the balance conventionally a mineral lubricating oil e.g. up to 90 wt. %, with or without other additives being present.

In the above compositions or concentrates, other conventional additives may also be present including dyes, pour point depressants, antiwear agents such as $P_2S_5$-treated terpene or zinc dialkyl dithiophosphates of 3 to 8 carbon atoms in each alkyl group, antioxidants such as N-phenyl-α naphthylamine, tert-octylphenol sulfide, 4,4'-methylene bis (2,6-di-tert-butyl phenol), viscosity improvers such as ethylene-propylene copolymers, polymethacrylates, polyisobutylene, alkyl fumarate-vinyl acetate copolymers and the like, de-emulsifiers such as polysiloxanes, ethoxylated polymers and the like.

The invention will be further understood by reference to the following use examples, which include preferred embodiments of the invention.

Gasoline Additives

The products of Examples 5 and 6 were tested for their effectiveness as gasoline antirust agents. Each product was first dissolved in xylene and the solutions added to the gasoline to incorporate the additive at a treat rate of 1.5 and 3 pounds of polyester additive per thousand barrels of gasoline. The gasoline so treated was then tested for rusting according to ASTM D-665M rust test. In brief, this test is carried out by observing the amount of rust that forms on a steel spindle after rotating for an hour in a water-gasoline mixture. In each case, the polyester treated gasoline gave a value of 1.0 i.e. no rust indicating that each product was very effective as an antirust additive since the untreated gasoline will form rust over the entire surface of the spindle.

When gasoline treated with 1.25 pounds/thousand barrels of the product of Example 5 was subjected to the National Association of Corrosion Engineers Rust Test (a/k/a the Colonial Pipe Line Rust Test which is published on pages 167–168 of Fuel Additives by M. William Ranney published by Noyes Data Corp. of Park Ridge, N.J. (1974) it gave a reading of B+ whereas the untreated gasoline resulted in a reading of E thus further showing the antirust activity of the polyester products of the invention in fuels.

Automatic Transmission Fluid Additive

As earlier indicated, the additives of the invention also have application as copper corrosion inhibitors. In particular, the product of Example 5 is a useful copper corrosion inhibitor for incorporation into automatic transmission fluids, (ATF). The ATF lubricants contain many component additives which are typically blended into the lubricating mineral oil at the following range of treating levels.

| Components | Concentration range, vol. % |
|---|---|
| V.I. improver | 1–15 |
| Corrosion inhibitor | 0.01–1 |
| Oxidation inhibitor | 0.01–1 |
| Dispersant | 0.5–10 |
| Pour point depressant | 0.01–1 |
| De-emulsifier | 0.001–0.1 |
| Anti-foaming agent | 0.001–0.1 |
| Anti-wear agent | 0.001–1 |
| Seal swellant | 0.1–5 |
| Friction modifier | 0.01–1 |
| Mineral oil | Balance |

The treat rate is obvious from the above typical formulation which has been blended for the ATF lubricant. The following data is illustrative of the copper corrosion inhibition improvement of an ATF lubricant.

A commercial ATF lubricant sold by Exxon Chemical Co. of Houston, Texas was examined in the following copper corrosion test in both modified (presence of 0.15 wt. % of product of Ex. 4) and unmodified form, in that the copper corrosion inhibitor was removed. The copper corrosion test is carried out as follows: A copper specimen 3"×½"×1/16" is polished until clean and uniform, washed in hexane, dried and weighed to the tenth of a milligram. 50 cc of the test fluid is placed in a test tube into which the copper bar is immersed, and the test tube thereafter corked with a cork with two ⅛" holes in it. The tube is placed in a 300° C. aluminum block for 72 hours. At the end of the time, the specimen is removed, washed in hexane, rubbed vigorously with paper towel to remove any loose deposits, rewashed and reweighed. Alternatively, the sample may be blown with dry air at 25 cc/min. during the test.

TABLE II

| Copper Corrosion Tests, mg. lost in 3 days | |
|---|---|
| ATF Lubricant | ATF No air blown |
| Unmodified | 21 |
| Modified by removal of 0.2 wt. % copper corrosion inhibitor and addition of 0.15 wt. % of Prod. Example 4 | 4.9, 3.3 |

The above data clearly shows the copper corrosion inhibition activity provided to the ATF by the additive of the invention.

Measurement of Corrosion Inhibition Activity in Lubricating Oils Using a Polarization Device The use of a polarization device having a platinum electrode (containing a 10% sodium sulfate solution) and an iron plate electrode disposed in a test cell wherein the test sample is placed has made possible the generation of laboratory data which is directly related to the rust performance of oils in the automobile engine. The test approach used herein was to compare commercially available 10W/40 SE oil available at any service station with said oil minus the anti-rust additive (0.61 wt. %) and the latter formulation to which varying amounts of the product of Ex. 4 has been added. The results are as follows:

TABLE III

| Sample | Type | Corrosion Rate Micrometers Dissolved/Year |
|---|---|---|
| 1 | commercial 10W/40 SE | 3.0, 2,6 |
| 2 | commercial minus 0.61 wt. % antirust additive | 7.0 |
| 3 | Sample 2 plus 0.63 wt. % product of Ex. 4 | 2.9 |
| 4 | Sample 2 plus 1.25 wt. % product of Ex. 4 | 2.1 |
| 5 | Sample 2 plus 2.5 wt. % product of Ex. 4 | 1.8 |

The above results show that when the additive of the invention is used at 0.6 wt. % to 2.5 wt. % its antirust activity in formulated lubricating oils is comparable to better than a commercially used additive at 0.6 wt. %.

Engine Fuel Economy Tests

The additives of the invention as represented by the product of Example 4 were evaluated as a friction-reducing (lubricity agent) additive for lubricating oils by use of both the Ball-on-Cylinder and the dynamometer fuel economy tests. The results of this evaluation are set forth in a paper No. 780599 entitled "Improved Fuel Economy via Engine Oils" by W. E. Waddey et al. published in 1978 by the Society of Automotive Engineers, Inc., 400 Commonwealth Drive, Warrendale, PA. 15096. Both of these two tests and the evaluation results are published therein. When a Premium SE 10W-40 oil (Oil 1) was compared with the same oil less the detergent which is replaced with 1.25 wt. % active ingredient of the product of Example 4 (Oil 5): the Ball-on-Cylinder test showed a friction measurement which was for Oil 5 only 52% of the friction measured for Oil 1; and, the dynamometer fuel economy test using a 350 CID (5.7-L) V-8 engine showed that the Oil 5 gave a 12.5 percent fuel economy improvement over that mileage/gallon value of Oil 1.

Thus, in summary the additives of the invention have been shown to provide rust inhibition activity to fuels; copper corrosion inhibition activity to automatic transmission fluids; and, rust inhibition, friction reduction and copper corrosion inhibition activities to lubricating oils.

It is to be understood that the Examples present in the foregoing specification are merely illustrative of the invention and are not intended to limit it in any manner; nor is the invention to be limited by any theory regarding its operability. The scope of the invention is to be determined by the appended claims.

The methylol polyester of 2-octadecenyl succinic anhydride and 2,2,6,6-tetramethylol cyclohexanol can be visualized as

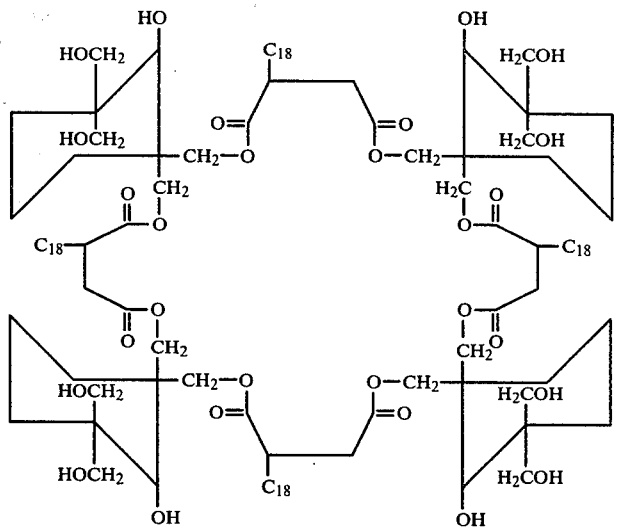

What is claimed is:

1. A hydrocarbon-soluble methylol polyester which is an equimolar reaction product of a $C_{12}$–$C_{22}$ hydrocarbon substituted succinic anhydride or acid and a cyclic poly(methylol) compound of the class consisting of 2,2,6,6-tetramethylol cyclohexanol, tetrahydro-3,3,5,5-tetrakis-(hydroxymethyl)-4-pyranol and tetrahydro-3,3,5-tris-(hydroxymethyl)-5-methyl-4-pyranol.

2. The reaction product according to claim 1 wherein said succinic anhydride is octadecenyl succinic anhydride.

3. The reaction product according to claim 2 wherein said compound is 2,2,6,6-tetramethylol cyclohexanol and has a number average molecular weight ranging from 2200 to 2800.

4. A methylol polyester according to the structure

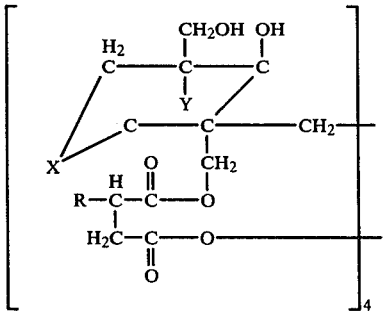

wherein X represents —$CH_2$ or —O—, y represents $CH_3$ or —$CH_2OH$ and R represents a hydrocarbon substituent of 12 to 22 carbons.

5. The methylol polyester according to claim 4 where R is 18(ave.) carbons, X represents —$CH_2$ and y represents —$CH_2OH$.

6. A composition comprising a major amount of liquid hydrocarbon of the class consisting of fuels and lubricants and at least a rust-inhibiting amount of a hydrocarbon-soluble methylol polyester which is an equimolar reaction product of a $C_{12}$–$C_{22}$ hydrocarbon substituted succinic anhydride or acid and a cyclic poly(methylol) compound of the class consisting of 2,2,6,6-tetramethylol cyclohexanol, tetrahydro-3,3,5,5-tetrakis-(hydroxymethyl-4-pyranol and tetrahydro-3,3,5-tris-(hydroxymethyl)-5-methyl-4-pyranol.

7. A composition according to claim 6 wherein said hydrocarbon is a lubricating mineral oil containing 0.01 to 20 wt. % of said methylol polyester.

8. A composition according to claim 6 wherein said hydrocarbon is a lubricating mineral oil containing at least a friction-reducing amount of said methylol polyester which is tetrakis [2,2'-bis methylene (1-hydroxy-6,6' dimethylol cyclohexyl) octadecenyl succinate].

9. A composition according to claim 6 wherein said liquid hydrocarbon contains from 20 to 90 wt. % of said methylol polyester.

10. A composition according to claim 6 wherein said fuel is gasoline and said methylol polyester is present in an amount ranging from 4 to 20 parts per million based on the total weight of said composition.

11. A method of preparing a hydrocarbon-soluble methylol polyester compound comprising the steps of condensing equimolar amounts of a $C_{12}$–$C_{22}$ hydrocarbon substituted succinic acid or anhydride and a cylic poly(methylol) compound of the class consisting of 2,2,6,6-tetramethylol cyclohexanol, tetrahydro-3,3,5,5-tetrakis-(hydroxymethyl)-4-pyranol and tetrahydro-3,3,5,5-tris-(hydroxymethyl)-5-methyl-4-pyranol at a temperature of from 100°–240° C. and removing the water of condensation from the product of condensation.

* * * * *